US005323542A

United States Patent [19]

Walzer

[11] Patent Number: 5,323,542

[45] Date of Patent: Jun. 28, 1994

[54] GARMENT MARKING MACHINE

[75] Inventor: Andrew Walzer, Tappan, N.Y.

[73] Assignee: Glo-Mark Systems, Inc., Tappan, N.Y.

[21] Appl. No.: 944,470

[22] Filed: Sep. 14, 1992

[51] Int. Cl.[5] ..... A41H 25/00

[52] U.S. Cl. ..... 33/576; 33/575; 33/662; 33/669; 33/DIG. 8

[58] Field of Search ..... 33/574–579, 33/666, 669, 35, 41.4, 45, DIG. 8, 662

[56] References Cited

U.S. PATENT DOCUMENTS

| | | |
|---|---|---|
| 784,089 | 3/1905 | Werle . |
| 1,019,139 | 3/1912 | Eberley . |
| 1,624,622 | 4/1927 | Pectal et al. . |
| 2,247,305 | 6/1941 | Morgan . |
| 2,572,682 | 10/1951 | Urish . |
| 2,925,661 | 2/1960 | Bagley . |
| 3,331,135 | 7/1967 | Urish . |
| 3,442,022 | 5/1969 | Maier . |
| 5,079,849 | 1/1992 | Nirenberg . |

OTHER PUBLICATIONS

Two Glo-Mark brochures illustrating various garment marking machines (four) incorporating upper markers only, and marking crayons (date unknown).

*Primary Examiner*—William A. Cuchlinski, Jr.
*Assistant Examiner*—Alvin Wirthlin
*Attorney, Agent, or Firm*—Willian Brinks Hofer Gilson & Lione

[57] ABSTRACT

A garment marking machine includes a lower marker-supporting track supported by a base plate, and a garment-supporting plate positioned and supported above the lower track. An upper marker-supporting track is positioned above the garment-supporting plate by means of posts that extend upwardly from the base plate and through the lower track and the garment-supporting plate. Marker assemblies positioned along the upper and lower marker tracks are used to mark garments processed by the garment marking machine. A marker assembly utilized in the garment marking machine includes a marker cap having a bore, a marker having a marking end disposed through the bore of the marker cap such that only a portion of the marker extends beyond the marker cap, and an adjusting rod operative to move the marking end of the marker through the bore of the marker cap. The bore of the marker cap is sized to tightly hold the marking end of the marker.

22 Claims, 7 Drawing Sheets

GARMENT MARKING MACHINE

BACKGROUND OF THE INVENTION

The present invention relates generally to the field of garment marking machines, and more particularly to improvements for such machines.

In producing garments, it is often necessary to mark the position where buttons, pockets, buttonholes, etc., are to be located. The garments are often marked by marking devices, e.g., crayons and inks, which are seen only under ultraviolet light or which disappear soon after application. This feature is necessary to prevent unsightly marks from remaining on the garments after production.

When marks for buttons and buttonholes are made on garments, it is desirable to make all of the marks simultaneously with the two fronts of the garment aligned together and with the top and bottom marks being made at the same points on the horizontal axis to insure proper alignment between the buttons and the buttonholes when they are subsequently placed on the garments. This operation is performed by marking a garment when the garment edges are juxtaposed and aligned.

A number of garment marking machines have been disclosed in prior U.S. Patents. Specifically, U.S. Pat. Nos. 3,331,135 and 2,572,682 disclose marking machines essentially including a machine frame on which is mounted a number of upper marking devices and a number of lower transfer markers. A slotted garment-supporting plate is positioned between the upper marking devices and the lower transfer markers. The lower transfer markers extend through the slot in the garment-supporting plate such that both the spring-loaded upper marking devices and the lower transfer markers mark the garment when the upper marking devices are lowered into contact with the garment.

The upper marking devices include marking media, e.g., crayons and inks, whereas the lower transfer markers comprise textured heads having no marking media. Thus, before a garment is placed in the marking machine for marking, the upper marking devices are lowered onto the heads of the lower transfer markers to deposit a portion of marking media onto the heads. Subsequent to this priming operation, the garment is placed in the marking machine and is marked by the marking media contained in the upper marking devices and the marking media deposited on the heads of the lower transfer markers.

After the marked garment is removed, the above-described priming operation must be repeated to load the lower transfer markers with marking media. The necessity of this priming operation results in lower marking efficiency and, thus, decreased garment production. Also, the marks left by the lower transfer markers are typically not as dark as those left by the upper marking devices. This often makes it difficult for sewing machine operators to identify the bottom marks, which results in decreased productivity.

Marking machines eliminating the above-described priming operation are known in the art. Specifically, such a marking machine is disclosed in U.S. Pat. No. 5,079,849. The '849 marking machine includes upper and lower marking plates mounted on a machine frame. Both the upper and lower marking plates includes a plurality of marking media, e.g., crayons, for marking a garment placed on a garment-supporting platen positioned intermediate the upper and lower marking plates.

Even though the '849 marking machine eliminates the need for the above-described priming operation through the use of upper and lower marking media, a number of disadvantages and/or problems still exist with the above-described marking machines. For example, the lower marking media are typically unstable because they extend too far beyond their holders. This design often causes the marking media to fracture during use. Also, if the upper and lower marking media are not perfectly aligned before commencement of the marking operation, the marking media will wear unevenly and, eventually, may break. Furthermore, the design of marking media holders has typically been such that the marking media are not easily removed and replaced.

Accordingly, it is an object of the present invention to provide a garment marking machine with marker assemblies which allow marking media to be positioned therein such that only a small portion of the marking media extends beyond the assemblies.

It is another object of the present invention to provide marker assemblies which allow the marking media to be easily removed and replaced with other marking media.

It is yet another object of the present invention to provide marker assemblies which can be easily moved between an operational and a neutral position.

It is yet still another object of the present invention to provide marker assemblies which can be easily adjusted horizontally along a marker-supporting track.

It is a further object of the present invention to provide marker assemblies which reduce the occurrence of marking media breakage during operation of the garment marking machine.

SUMMARY OF THE INVENTION

According to a first aspect of the present invention, a garment marking machine is provided including a marker assembly comprising a marker cap having a bore, a marker having a marking end disposed through the bore of the marker cap such that only a portion of the marker extends beyond the marker cap, the bore of the marker cap sized to tightly hold the marking end of the marker, and an adjusting rod operable to move the marking end of the marker through the bore of the marker cap.

According to a second aspect of the present invention, a garment marking machine is provided including a marker track, at least one marker assembly positioned along the marker track, the at least one marker assembly including a marker cap having a bore and a marker disposed through the bore of the marker cap, the bore of the marker cap sized to tightly hold the marker, and at least one track spacer operative to move the marker track with respect to the at least one marker assembly between an operating position and a second position where the marker cap extends beyond the marker track, the marker cap and the marker of the at least one marker assembly being removable when the marker track is moved by the at least one track spacer to the second position.

According to a third aspect of the present invention, an improvement for a garment marking machine of the type having lower and upper marker tracks supporting a plurality of markers is provided, including an eccentric pulley, and a slip collar disposed around the pulley, the eccentric pulley causing the slip collar to cyclically move upwardly and downwardly with respect to the pulley as the pulley is rotated, the slip collar operationally linked to the plurality of markers such that the upward and downward motion of the slip collar causes the lower and upper markers to oscillate in opposite directions.

According to a fourth aspect of the present invention, there is provided a marker assembly for a garment marking machine including a housing having a first portion and a second portion connected by a bore, a collet positioned in the first portion of the housing, the collet having a marker disposed in a first end thereof and an axial bore disposed from the first end of the collet to a second end, the bore of the housing aligned with the axial bore of the collet, and a spring-loaded shaft retained within the bore of the housing, the shaft operative to enter the axial bore of the collet and to eject the marker disposed within the collet when the housing is moved relative to the shaft.

According to a fifth aspect of the present invention, there is provided a marker assembly for a garment marking machine including a marker housing having an L-shaped slot therein, and a pin having a first end riding within the slot and a second end retained within a shaft disposed within the marker housing, whereby the marker assembly is locked in a raised position by moving and rotating the marker housing such that the pin is moved to the leg section of the L-shaped slot.

According to a sixth aspect of the present invention, there is provided a garment marking machine including a marker track comprising a fixed marker assembly and a plurality of adjustable marker assemblies, and a gate spacer comprising a plurality of movably connected slats each having a center hole, the center hole of each slat disposed around one of the fixed or adjustable marker assemblies, the gate spacer movable with respect to the fixed marker assembly such that the adjustable marker assemblies are moved by the gate spacer along the marker track.

The invention itself, together with further advantages and improvements over the prior art, will be best understood by reference to the following detailed description taken in conjunction with the accompanying drawings.

DETAILED DESCRIPTION OF THE PRESENTLY PREFERRED EMBODIMENTS

Figure 1:
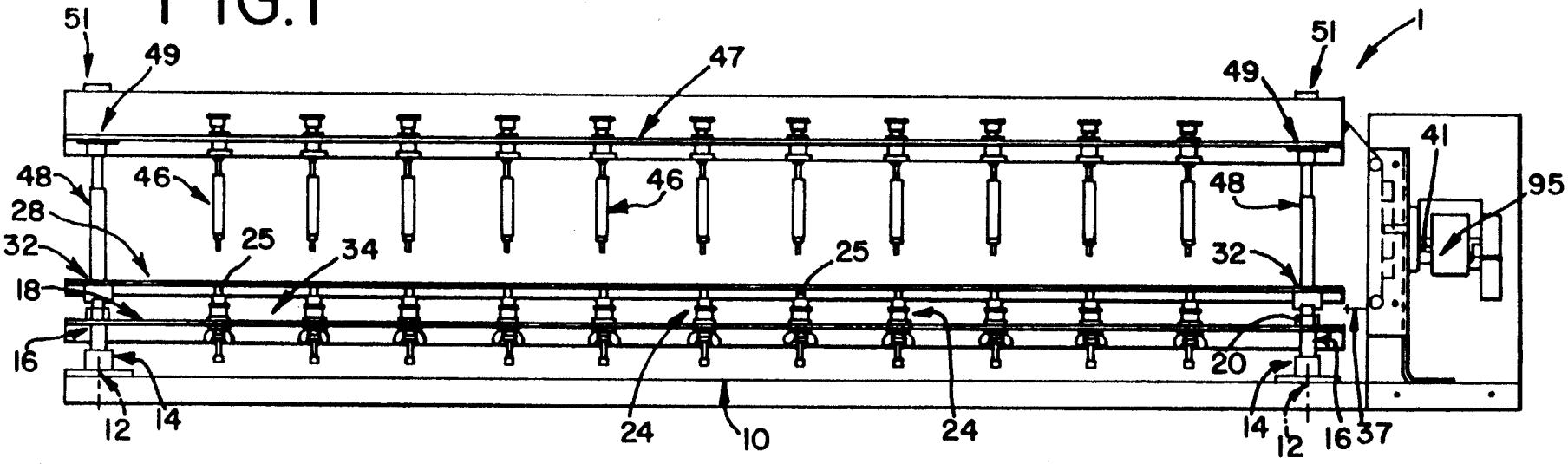
FIG. 1 is an elevational view of a garment marking machine of the present invention.
Figure 4:
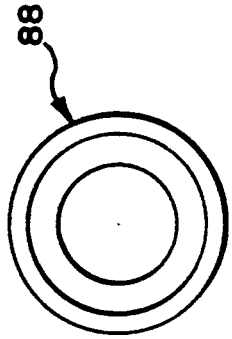
FIG. 4 is an end view of the marker cap of FIG. 3.
Figure 3:
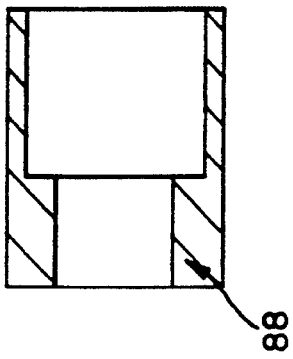
FIG. 3 is a cross-sectional view of the marker cap shown in FIG. 2.

Referring to FIG. 1, one embodiment of the marking machine 1 comprises a base plate 10 having a hole 12 adjacent each end thereof. A flanged collar 14 is fixed on the upper surface of the plate 10 around the edge of each hole and receives an elongated sleeve 16, the bottom of which rests on the plate 10. A narrow marker-supporting track 18, suitably fastened on the upper ends of the sleeves 16, has openings 20 adjacent its ends in line with the openings in the sleeves 16 and plate 10. It also has an elongated central slot 22 (see FIG. 2) extending between parts spaced from the ends thereof.

Figure 2:
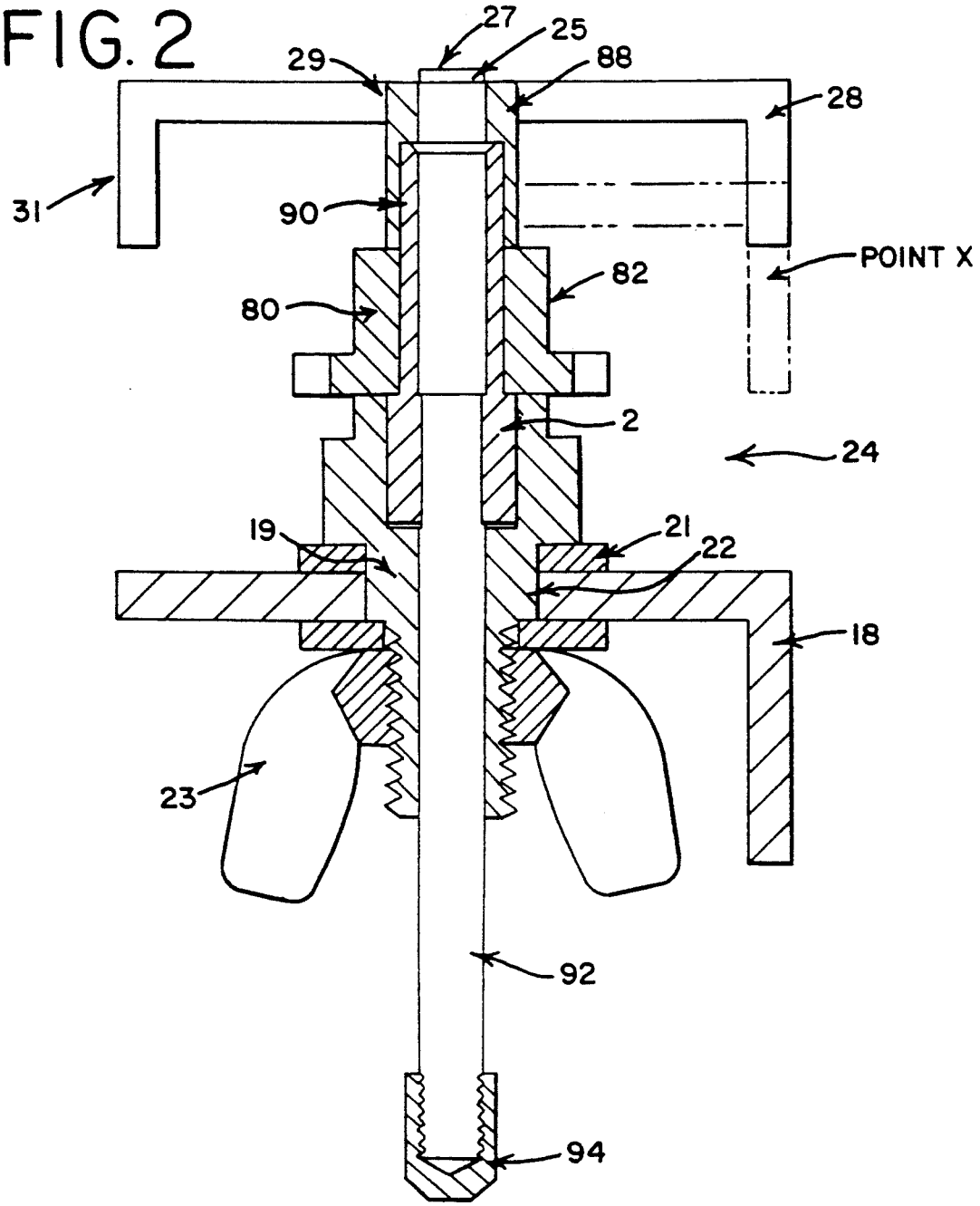
FIG. 2 is an elevational view of the lower marker assembly of the present invention.
Figure 5:
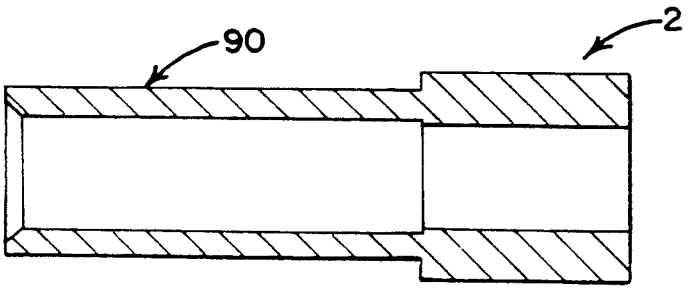
FIG. 5 is a cross-sectional view of the marker hub shown in FIG. 2.
Figure 6:
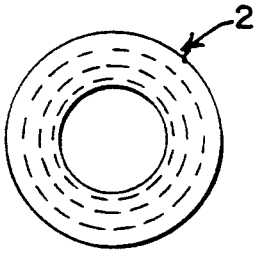
FIG. 6 is an end view of the marker hub of FIG. 5.
Figure 7:
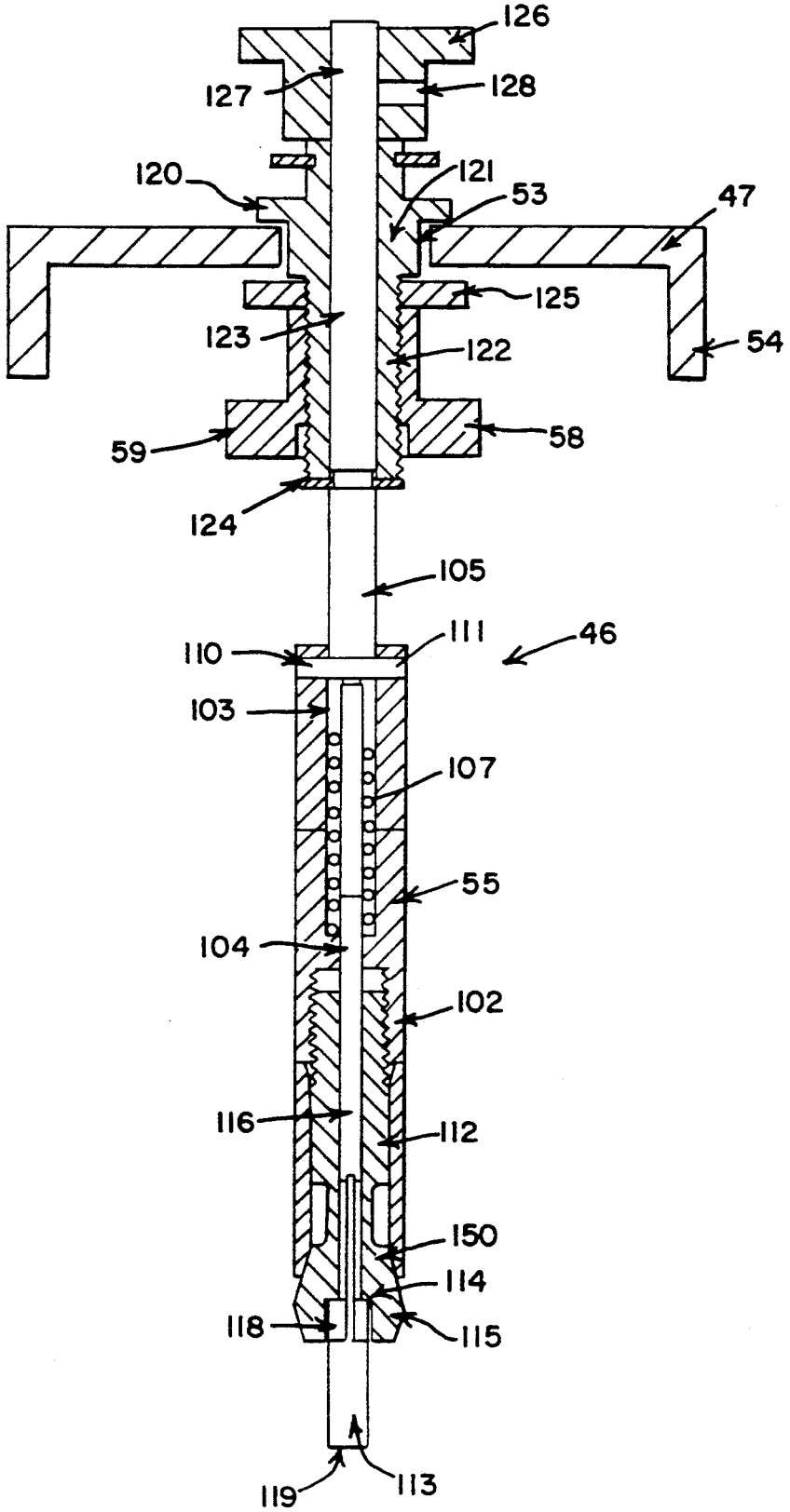
FIG. 7 is an elevational view of the upper marker assembly of the present invention.
Figure 8:
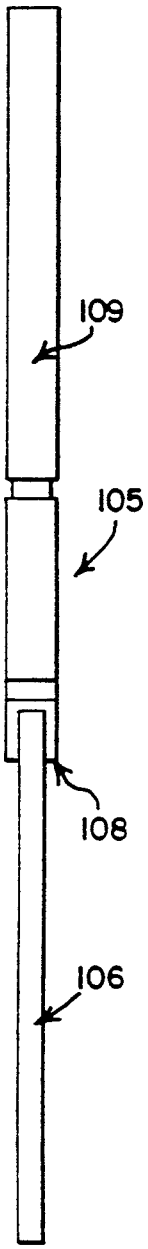
FIG. 8 is an elevational view of the shaft disposed within the upper marker assembly of FIG. 7.
Figure 9:
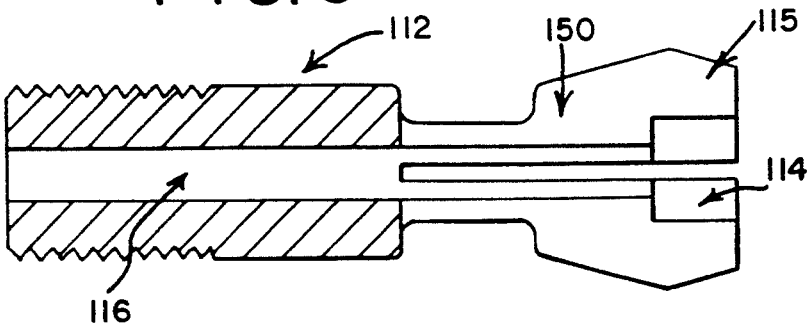
FIG. 9 is a cross-sectional view of the collet shown in FIG. 7.
Figure 10:
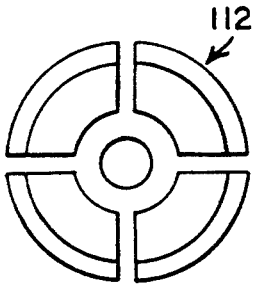
FIG. 10 is an end view of the collet of FIG. 9.
Figure 11:
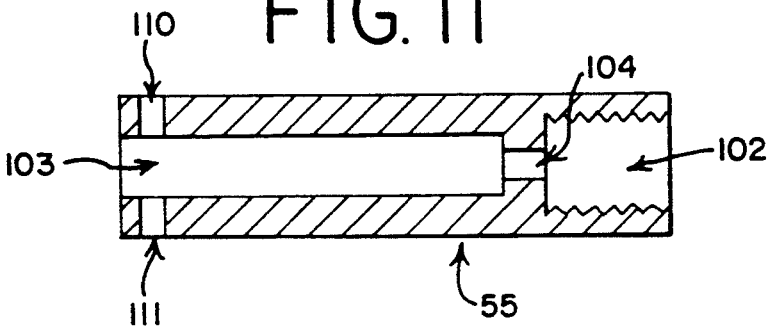
FIG. 11 is a cross-sectional view of the housing shown in FIG. 7.
Figure 12:
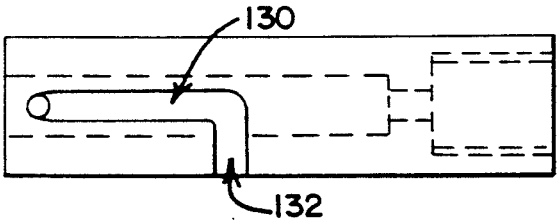
FIG. 12 is a side view of the housing of FIGS. 7 and 11 showing an L-shaped slot and, in phantom lines, the interior bores.
Figure 13:
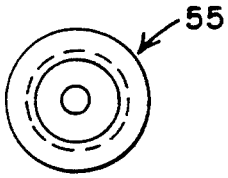
FIG. 13 is an end view of the housing of FIGS. 7, 11 and 12.
Figure 14:
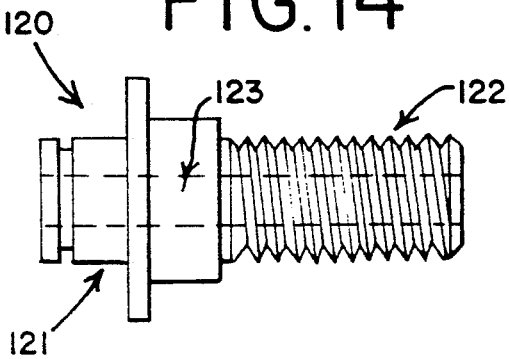
FIG. 14 is a side view of the marker bearing shown in FIG. 7.
Figure 15:
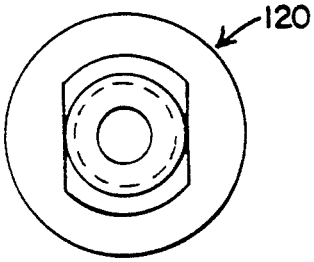
FIG. 15 is an end view of the marker bearing of FIG. 14.

Referring to FIGS. 1 and 2, supported on track 18 and adjustable therealong is a plurality of spaced marker assemblies 24, each marker assembly comprising a bushing 19 extending loosely through the slot 22 and a hub 2 residing within the bushing 19. Each bushing 19 is externally screw threaded along its lower portion and has a smooth upper portion to which is secured a washer 21 which is adapted to seat between the upper surface of the track 18 and the upper portion of the bushing 19. A wing nut 23 is adjustably mounted on the threaded portion of each bushing 19 below the track 18 for clamping each bushing 19 and its washer 21 to the track 18 at a selected location. A marker (e.g., crayon) 25 is inserted through the top of the hub 2 until the top of the marker 25 is even with the top of the hub 2. An internally threaded marker cap 88 is then turned onto an externally threaded portion 90 of the hub 2. An externally threaded adjusting rod 92 is inserted through the bottom of the marker assembly 24 until the top of the rod 92 engages the bottom of the marker 25 in the hub 2. The adjusting rod 92 is turned until only a small portion of the marker 25 (i.e., approximately 1/32 of an inch) extends beyond the marker cap 88. When the marker 25 has worn down or a new marker is to be inserted into the marker assembly 24, the marker 25 may be pushed through the hub 2 into the marker cap 88 by turning the adjusting rod 92 via the end cap 94. The marker cap 88 is then unscrewed from the hub 2 and the old marker 25 is removed from the marker cap 88.

The bore of the marker cap 88 is preferably sized to be of a smaller diameter than that of the marker 25 so that the marker cap 88 will securely grip the marker 25. Most preferably, the bore diameter of the marker cap 88 is sized to be 0.001 inches smaller than the diameter of the marker 25.

Fixed on the hub 2 of the marker assembly 24, between the bushing 19 and the marker cap 88, is an internally threaded gear or sprocket wheel 80 with an elongated hub portion 82 extending upwardly along the marker assembly 24.

The marker assemblies 24 may be slid along the slot 22 of the track 18 in order to adjust the spacing therebetween and may then be clamped in adjusted positions by their wing nuts 23.

As shown in FIG. 1, a garment-supporting plate 28 is positioned above the marker-supporting track 18 and supported by adjustable track spacers 170, discussed below. The plate 28 is formed with an elongated central slot 29 in the same vertical plane, corresponding to the slot 22 of track 18, and through which the exposed portions 27 of the markers 25 protrude a slight distance. The plate 28 is formed with flanges 31 on its long edges and with openings 32 at its ends in alignment with the openings 20 in plate 18.

Figure 22:
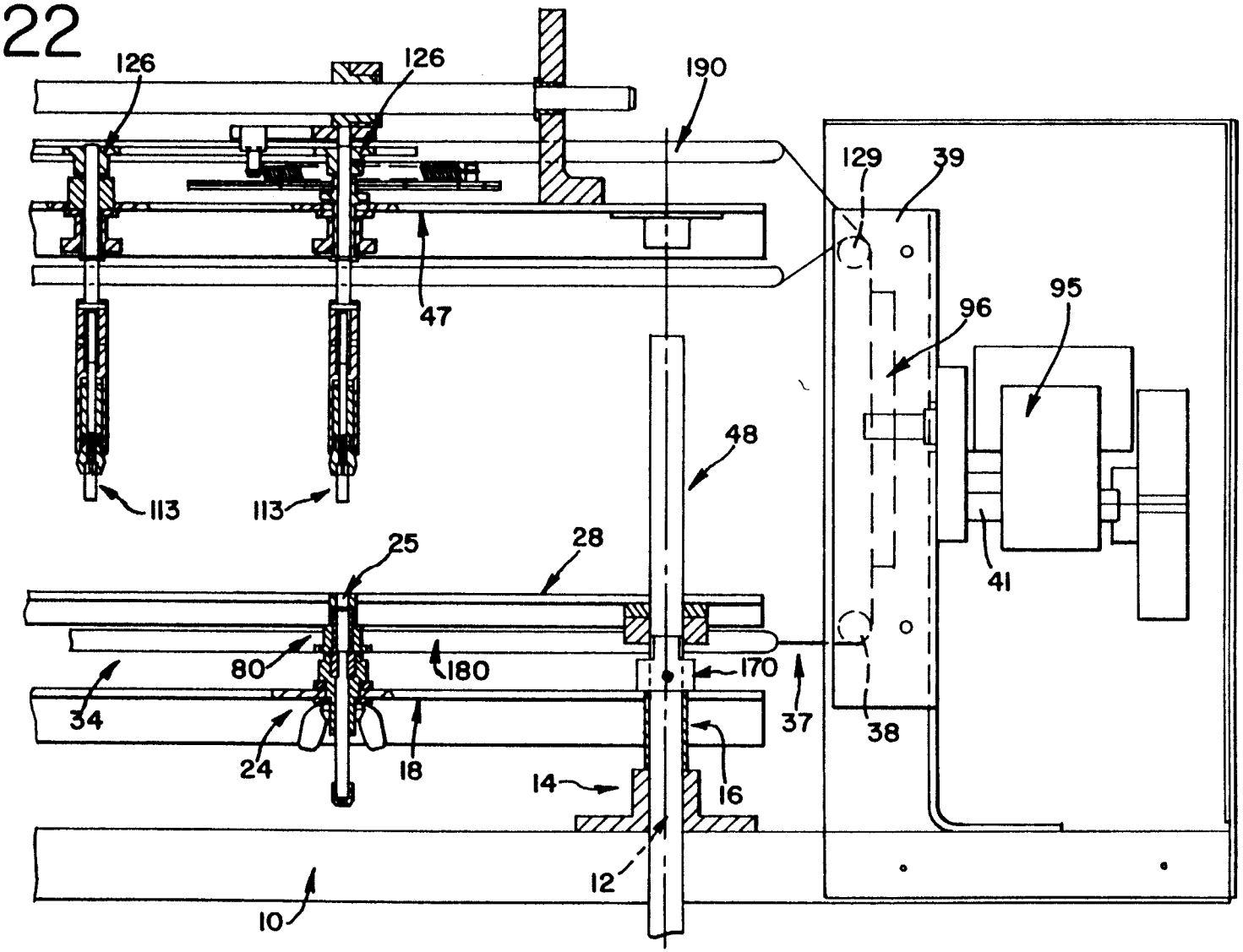
FIG. 22 is an enlarged view of the transmission system shown in FIG. 1.

As best shown in FIG. 22, the markers 25 of the marker assemblies 24 are simultaneously oscillated (approximately 120°) at the proper times by a sprocket chain 180 which extends along the space 34 formed by the track 18 and the plate 28, and which is in mesh with the wheels 80, which are positioned in said space 34. One end of this chain 180 is connected to one end of a coil spring (not shown), the other end of the coil spring being secured to a fastening member on the under surface of plate 28. The other end of the chain 180 is connected to a pull cord or cable 37 and passes out from the space 34 beyond the ends of the track 18 and the plate 28, and is connected to a pin 38 mounted on a slip collar 39. The slip collar 39 is mounted on a pulley 96 having an eccentric shaft hole 98 which carries the drive shaft 41 of a motor 95.

As best shown in FIGS. 1 and 22, upper or other series of marking devices 46 is supported on an upper marker track 47. The upper marker track 47 slides or reciprocates with and is operated by elongated posts 48 which may be connected to a treadle (not shown) at their lower ends and which extend upwardly throughout the aligned openings in the base plate 10, sleeves 16, track 18, plate 28, and through openings 49 in the upper marker track 47 at the ends thereof. Upward movement of the upper marker track 47 on the posts 48 is limited by nuts 51 on the upper threaded ends of said posts. The upper marker track 47 is normally maintained in uppermost position by compression springs (not shown) around the posts 48, which springs sit on the plate 28 and press against the upper marker track 47. The upper marker track 47 is formed with an elongated central slot 53 and may have a reinforcing flange 54 along one edge thereof.

As shown in FIGS. 7–15, each upper marking device 46 comprises a housing 55 having a first internal portion 102 and a second internal portion 103 connected via an intermediate bore 104. Preferably, the diameter of the first portion 102 is larger than that of the second portion 103, and the diameter of the bore 104 is smaller than the diameters of both the first portion 102 and the second portion 103. A dual diameter shaft 105 is partially disposed within the housing 55, with the small diameter section 106 of the shaft 105 extending through the second portion 103 of the housing 55 into the first portion 102. The large diameter section 109 of the shaft 105 is sized to fit within the second portion 103 of the housing 105. A spring 107 resides within the second portion 103 of the housing 55 and engages a shaft flange 108 located at the interface of the dual diameter sections of the shaft 105. The spring 107 biases the shaft 105 from entering further into the housing 55. A spring pin 110 is inserted through a bore 111 in the housing 55, and through the shaft 105, to retain the spring 107 within the housing 55. Additionally, the spring pin 110 limits the upward and downward motion of the housing 55, and allows the housing 55 to rotate with the shaft 105.

While the diameters of the internal portions 102, 103 of the housing 55 and the shaft sections 106, 109 of the shaft 105 may be of any size suitable for the application, preferably the diameters of the small section 106 and the large section 109 of the shaft 105 are 3/32" and 3/16", respectively. Additionally, the diameters of the internal portions 102, 103 of the housing 55 are preferably sized to accommodate the above-mentioned shaft diameters within reasonable tolerances.

A collet or chuck member 112 is detachably supported within the first portion 102 of the housing 55. The collet 112 comprises a tubular body of spring metal which is slit at its lower end 150 to form spring jaws 115. An upper marker (e.g., crayon) 113 is inserted between the spring jaws 115, the inner end 118 of the marker 113 impinging against the end of a recess 114 in the collet 112 and its outer end 119 protruding slightly beyond the ends of the spring jaws 115. A longitudinal channel 116 extends through the collet 112 to the recess 114. The channel 116 is sized to accommodate the entry of the small diameter section 106 of the shaft 105 such that the shaft 105 can enter the recess 114 and engage the marker 113. By moving the housing 55 up in a direction away from the marker 113, the spring 107 and the housing 55 cooperate to allow the small section 106 of the shaft 105 to eject the marker 113 from the collet 112. However, ejection of the marker 113 will only occur easily if the collet 112 is loosened a bit from the housing 55. Otherwise, vibration of the marking machine may cause the marker 113 to be ejected during operation. It should be understood that any other suitable form of collets may be used for clamping the markers 113.

Extending through the slot 53 in the upper track 47 is a marker bearing 120 having an upper section 121 and externally threaded lower section 122. The large section 109 of the shaft 105 resides within a longitudinal bore 123 in the marker bearing 120. A retaining ring 124 locks the shaft 105 in position relative to the marker bearing 120.

A thrust bearing 125 is positioned along the lower section 122 of the bearing 120 such that it is positioned between the upper track 47 and the lower section 122 of the marker bearing 120. Threaded on the lower section 122 of the marker bearing 120 below the upper track 47 is a nut 58 which engages the lower surface of the thrust bearing 125. Each nut 58 has a knurled annular flange 59 which serves as a finger piece for turning it to clamp the upper mark track 47 against the thrust bearing 125 and the upper section 121 of the marker bearing 120.

Mounted atop the marker bearing 120 is a sprocket 126 having an axial bore 127 in alignment with the longitudinal bore 123 of the marker bearing 120. The larger section 109 of the shaft 105 extends from the bore 123 of the marker bearing 120 through the sprocket bore 127. The sprocket 126 is fastened to the shaft 105 by means of a set screw 128.

As best shown in FIG. 22, the markers 113 on the upper marker track 47 are simultaneously oscillated at the proper times by a drive chain 190 engaging the sprockets 126. One end of the drive chain 190 is connected to a pin 129 carried on the slip collar 39. The other end of the drive chain 190 is connected to one end of a return spring (not shown), the other end of which is secured to a bracket carried by the upper marker track 47.

Figure 16:
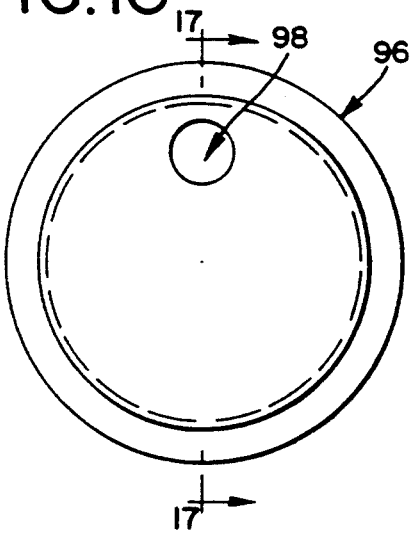
FIG. 16 is a front view of the pulley shown in FIG. 1.
Figure 17:
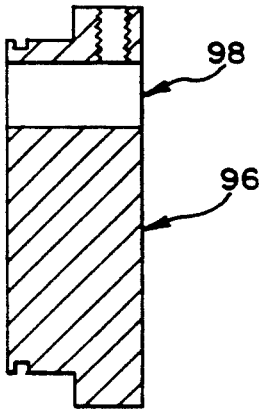
FIG. 17 is a cross-sectional view taken along line 17—17 of FIG. 16.
Figure 18:
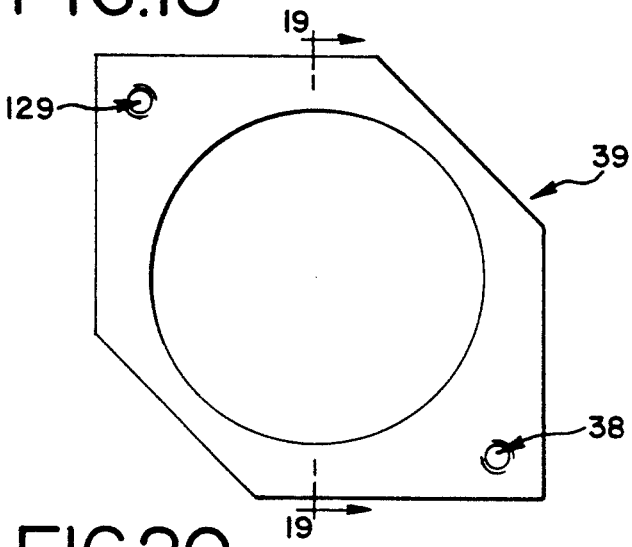
FIG. 18 is a front view of the slip collar shown in FIG. 1.
Figure 19:
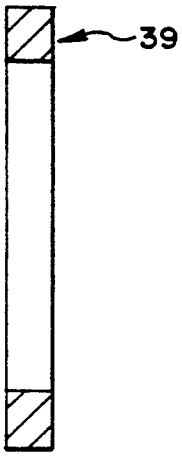
FIG. 19 is a cross-sectional view taken along line 19—19 of FIG. 18.

As shown in FIGS. 1 and 22, the operating shaft 41 is driven by a motor 95 which turns a pulley 96 having an eccentric shaft bore 98 (See FIGS. 16 and 17). A slip collar 39 (See FIGS. 18 and 19) is disposed around the pulley 96 such that when the pulley 96 turns the slip collar 39 moves up and down. Attached to opposite ends of the slip collar 39, as discussed above, are cables connected to the upper and lower drive chains 190, 180, respectively.

When the slip collar moves upwardly a half-inch along the rotating eccentric pulley 96, the upper and lower marker assemblies 46, 24 oscillate in opposite directions to prevent the garment material from bunching. Accordingly, when the slip collar 39 moves downwardly along the pulley 96, the marker assemblies 46, 24 move in an opposite oscillatory direction. It should be noted that the motor 95 and the transmission means are mounted perpendicularly to the upper and lower marker tracks 47, 18 to enable the opposite ends of one slip collar 39 to be used for driving both the upper and lower markers 25, 113 in opposite oscillatory directions.

In operation, the lower markers 25 on the track 18 and the upper markers 113 on the upper marker track 47 are adjusted along the slot portions of their supports so that they are spaced as desired and are in exact alignment with one another. When the markers 113 are properly adjusted, the upper marker track 47 is moved downwardly by hand, treadle or other suitable means (not shown) against the action of the post springs to bring the markers 113 into contact with the garment.

Just before the markers 25, 113 touch the garment, a push rod carried by the upper marker track 47 contacts an operating spring for a microswitch, which causes the drive motor 95 to be activated. Thus, the motor 95 is started to thereby effect oscillation of the markers 25, 113 through turning of the pulley 96. Such contact stops further downward movement of the markers 113.

The two parts or edges of a garment to be marked for buttons and buttonholes are inserted between the upper and lower sets of markers 113, 25 in overlying relation, with the lower part of the garment positioned on top of the plate 28 over the markers 25 on track 18 and with the upper part of the garment directly under the upper markers 113 carried by the upper marker track 47. The upper marker track 47 is moved downwardly as aforesaid, carrying the markers 113 into pressing engagement with the upper surface of the upper or overlapping piece of the garment, causing closure of the microswitch, operation of the motor 95 and turning of the markers 25, 113, whereby the markers 25, 113 are oscillated/rotated against the respective upper and lower surfaces of the garment positioned therebetween for effectively marking the same.

If a garment is to have less buttons than usual, i.e., five buttons instead of six, a preferred embodiment of the present invention allows the upper markers 113 to be locked in a raised position in the upper marker track 47. This is done by providing the housings 55 of the upper marking devices 46 with an L-shaped slot 130 (See FIG. 12) therein. When a particular marker 113 is not required for a marking operation, the collet 112 is loosened and the marker housing 55 is upwardly pressed along the shaft 105 toward the upper marker track 47. The small section 106 of the shaft 105 then ejects the marker 113 and the housing 55 is turned such that the spring pin 110 retained in the shaft 105 is maneuvered into the leg portion 132 of the slot 130. In this position, the pin 110 prevents the marker assembly 46 from lowering to its operational position.

As discussed above, the preferred design of the lower and upper marker tracks 18, 47 included central slots 22, 53 extending longitudinally therethrough. The slots 22, 53 permit the marker assemblies 24, 46 to be positioned at any location therealong. In an alternate embodiment, the lower and upper tracks 18, 47 may be designed with stationary center marker assemblies (not shown) located at the midpoints of the tracks 18, 47, and slots located in the tracks 18, 47 to the left and to the right of the stationary marker assemblies. The slots allow for lateral positioning of the remaining marker assemblies 24, 46 along the lower and upper tracks 18, 47. Since the alternate design does not feature a slot disposed along the almost entire length of the lower and upper tracks 18, 47, the alternate design provides for more stable and stronger lower and upper tracks 18, 47.

Figure 23:
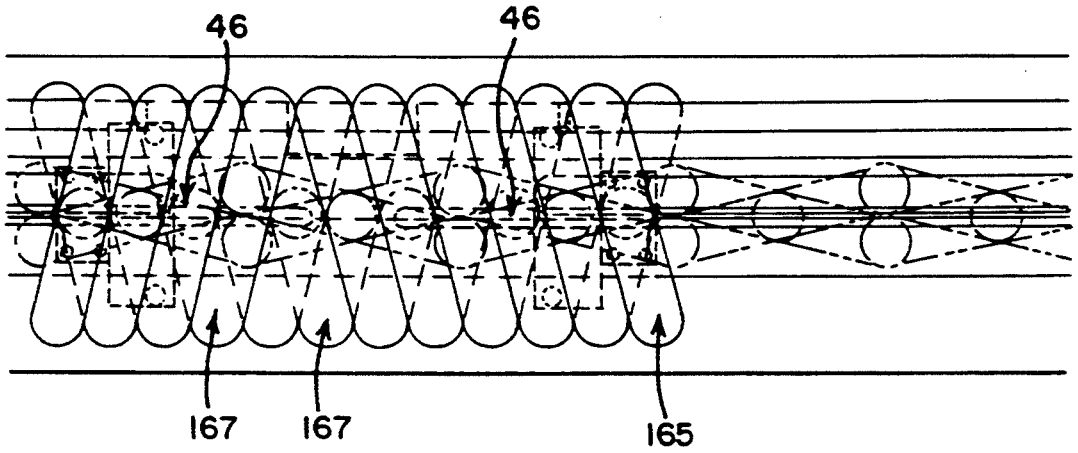
FIG. 23 is a top view of the garment marking machine of FIG. 1 showing a gate spacer.
Figure 24:
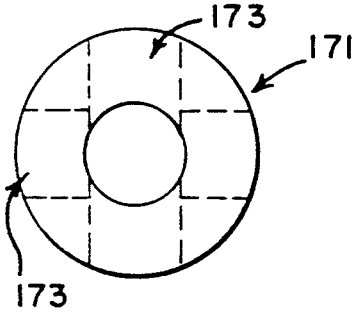
FIG. 24 is a top view of the top section of the track spacer.
Figure 25:
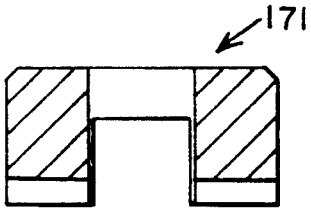
FIG. 25 is a front view of the top section of the track spacer of FIG. 24.
Figure 26:
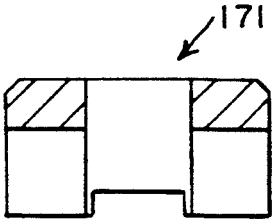
FIG. 26 is a side view of the top section of the track spacer of FIG. 25.
Figure 27:
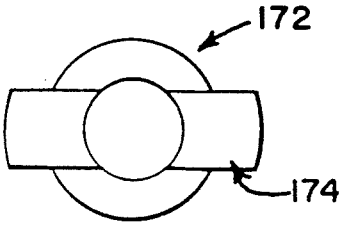
FIG. 27 is a top view of the bottom section of the track spacer.
Figure 28:
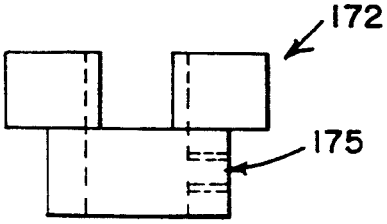
FIG. 28 is a front view of the bottom section of the track spacer of FIG. 27.
Figure 29:
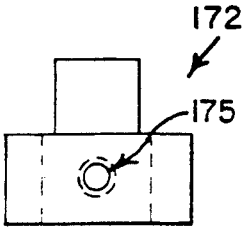
FIG. 29 is a side view of the bottom section of the track spacer of FIG. 28.

Furthermore, this alternate design allows for an improved gate spacer. As shown in FIG. 23, the gate spacer 165 preferably comprises criss-crossed metal slats 167 having their centers mounted around the tops of the marker bearings 120 (below the sprockets 126). With the center marker assemblies being fixed, the gate spacer 165 is able to position the remaining marker assemblies 46 (positioned to the left and to the right of the center marker assemblies) with increased accuracy. Also, since the gate spacer 165 is connected to the marker assemblies 46, the marker assemblies 46 are easily moved. Furthermore, tension springs (not shown) may be positioned between the slats 167 to maintain the slats 167 in a rigid fashion, thereby maintaining the accuracy of the gate spacer 165. Additionally, while the gate spacer 165 was described above only in conjunction with the upper marker assemblies 46, it should be understood that the gate spacer 165 may also be used with the lower marker assemblies 24.

Figure 20:
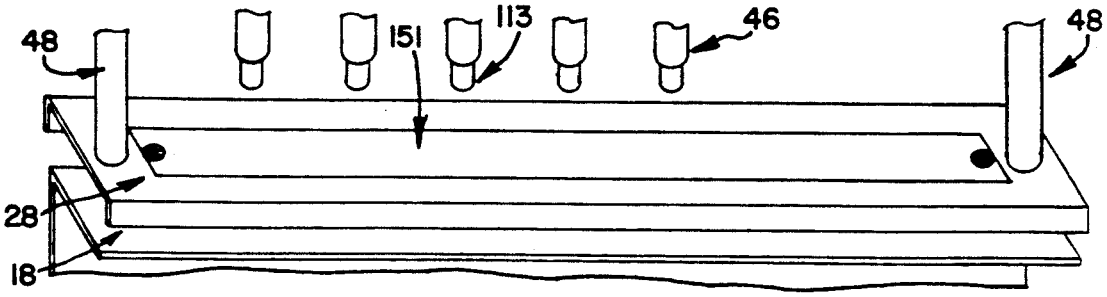
FIG. 20 is front perspective view of a memory strip of the present invention.
Figure 21:
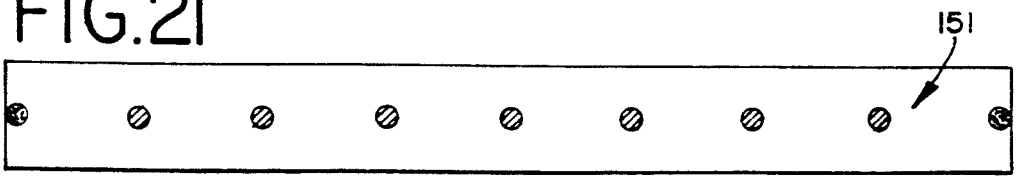
FIG. 21 is a top view of a hole-punched memory strip.

Related to the above-described gate spacer is a memory strip 151 (See FIGS. 20 and 21) which can be used with the garment-supporting plate 28 discussed above. The top surface of the memory strip 151 may be coated with any suitable substance that changes color when touched by the markers 25, 113. When a specific garment is to be marked, the upper and lower markers 113, 25 are positioned along the upper and lower tracks 47, 18 to correspond to the locations of the garment's buttons and buttonholes. Before the garment is marked, the machine operator may secure the memory strip 151 to the garment track 28 and move the upper and lower markers 113, 25 into contact with the strip 151. The operator removes the strip 151 and punches holes in the strip 151 where the above-described color changes occur. These holes correspond to the marker positions required for the specific garment to be marked. Since, typically, the location of buttons and buttonholes vary between different garments, adjustment of the markers 25, 113 is required for each style/design of garment. By marking the locations of the markers 25, 113 for particular garments on an overlaid memory strip 151, a marker location template can be made for each garment. Thus, when the same style of garment is to be marked at a later date, the memory strip 151 can be used to quickly position the markers 25, 113 in their proper locations. It should be understood that the memory strip 151 may be formed of any suitable material, including manila cardboard. Alternately, visible markers could be used for the marking of the memory strip 151, thereby eliminating the need for the above-described substance coating.

Additionally, the garment marking machine 1 of the present invention may be provided with an adjustable electronic timing circuit (not shown) limiting the length of the marking operation. The timer begins to run when the microswitch activates the motor 95, which in turn rotates the marker assemblies 24, 46, as discussed above. After the prescribed marking time period, the timing circuit deactivates the motor 95. The timing circuit has the advantages of minimizing marking time and increasing operator productivity. Furthermore, the timing circuit may also include a beeper for alerting the operator that the marking time has ended.

To facilitate alignment of the upper and lower markers 113, 25, a cable (not shown) may be connected between the upper track 47 and the lower track 18 when the upper track 47 is brought to an operating position. In this position, the two tracks 47, 18 are sufficiently close together to allow for quick and easy marker alignment. Alternately, this function may be performed by a movable rod (not shown) attached to a pull-bar (not shown) located beneath the marking machine 1. The pull-bar is attached to the posts 48, which transmit the downward motion of the upper track 47 to the pull-bar. When the upper track 47 is in its "down" position, the movable rod is raised until it rests between the pull-bar and the bottom 10 of the machine 1, thereby preventing the upper track 47 from raising.

Removal and/or replacement of the lower markers 25 is allowed through operation of track spacers 170 disposed around the posts 48 which support the lower track 18. As shown in FIGS. 24–29, each track spacer 170 preferably comprises a top section 171 and a bottom section 172. The top section 171 comprises two channels 173 positioned perpendicular to one another and the bottom section 172 comprises an upstanding edge 174. The top section 171 rides atop the bottom section 172 of the track spacer 170 unless the top section 171 is turned to a position where the upstanding edge 174 of the bottom section 172 is aligned with one of the slots 173 (i.e., every 90°). In this position, the top section 171 of the spacer 170 lowers relative to the bottom section 172, thereby encircling the bottom section 172. Such movement of the top section 171 causes the track 18 to lower. When the track 18 is lowered, the marker caps 88 of the lower marker assemblies 24 extend above the slot 22 in the track 18 (See Point X in FIG. 2). The distance the track is lowered (approximately 5/16") is sufficient to allow one to unscrew the marker caps 88. As described above, when the marker caps 88 are removed, they take the remaining marker bits with them, and new markers 25 may then be inserted into the uncovered hubs 2. After the markers 25 are replaced, the top sections 171 of the spacers 170 are turned to a position where they ride atop the bottom sections 172, thereby extending the spacers and raising the track 18 into its operating position. The spacer 170 may be connected to the post 48 by means of a set screw (not shown) disposed through a bore 175 in the bottom section 172 of the spacer.

Furthermore, the garment marking machine 1 may be provided with guide bars (not shown) supported along the lower track 18 for marking double-breasted garments. A first guide bar is perpendicularly adjustable approximately 3 inches from the centerline of the lower track 18 for marking a first row of buttons. A second adjustable guide bar is mounted on top of the first bar for marking a second row of buttons. In this manner, the first and second guide bars can independently adjust the distance between the two rows of buttons/buttonholes in a double-breasted garment.

Any suitable type of marker may be utilized, but fluorescent crayons which make marks invisible in normal light so as not to degrade the garment, but which are visible under blacklights positioned at sewing machine operators' tables, are preferred.

It should be appreciated that the above-described embodiments of the garment marking machine may be configured as appropriate for the application. The embodiments and improvements described above are to be considered in all respects as illustrative and not restrictive. The scope of the invention is indicated by the following claims rather than by the foregoing description. All changes which come within the meaning and range of equivalency of the claims are to be embraced within their scope.

I claim:

1. A garment marking machine comprising:

a) a marker track having at least one marker assembly positioned along said marker track, the at least one marker assembly comprising:

i) a marker cap having a bore, and ii) a marker disposed through the bore of the marker cap, the bore of the marker cap sized to tightly hold the marker;

b) a garment-supporting plate supported above the marker track; and c) at least one track spacer operative to allow said garment-supporting plate to move with respect to the at least one marker assembly between an operating position and a second position where the marker cap extends beyond said garment-supporting plate, the marker cap and the marker of the at least one marker assembly being removable when said garment-supporting plate is moved by said track spacer to the second position, the at least one track spacer comprising:

i) a top section comprising at least one channel therein, and ii) a bottom section comprising at least one upstanding edge sized to fit within the at least one channel of the top section, the top section operative to lower relative to the bottom section when the top section is rotated to a position where the at least one upstanding edge fits within the at least one channel.

2. The garment marking machine of claim 1 wherein said garment-supporting plate is shaped to define a slot therein, and further wherein the marker cap of the at least one marker assembly resides within the slot when said garment-supporting plate is in the operating position.

3. The garment marking machine of claim 1 wherein said at least one track spacer is disposed around at least one support post operable to support said garment-supporting plate within the garment marking machine.

4. The garment marking machine of claim 1 wherein the top section of said at least one track spacer comprises two channels.

5. The garment marker machine of claim 1 wherein the at least one marker assembly comprises a fixed marker assembly and a plurality of adjustable marker assemblies.

6. The garment marking machine of claim 5, further comprising a gate spacer comprising a plurality of movably connected slats each having a center hole, the center hole of each slat disposed around one of the fixed or adjustable marker assemblies, said gate spacer movable with respect to the fixed marker assembly such that the adjustable marker assemblies are moved by said gate spacer along said marker track.

7. The garment marking machine of claim 6 wherein the slats of said gate spacer are connected such that they are criss-crossed.

8. The garment marking machine of claim 7 wherein at least one end of a respective slat is movably connected to an end of an adjacent slat.

9. In a garment marking machine of the type having lower and upper marker tracks respectively supporting a plurality of lower and upper markers, the improvement comprising:

a) an eccentric pulley driven by a means for powering the garment marking machine;

b) a slip collar disposed around said pulley, said eccentric pulley causing said slip collar to cyclically move upwardly and downwardly with respect to said pulley as said pulley is rotated, said slip collar operationally linked to the plurality of lower and upper markers by a linkage connected to opposite portions of said slip collar such that the upward and downward motion of said slip collar causes the lower markers and the upper markers to oscillate in opposite directions.

10. The invention of claim 9 wherein the means for powering the garment marking machine comprises a motor.

11. The invention of claim 9 wherein the plurality of upper markers comprises a fixed marker and a plurality of adjustable markers.

12. The invention of claim 11, further comprising a gate spacer comprising a plurality of movably connected slats each having a center hole, the center hole of each slat disposed around one of the fixed or adjustable markers, said gate spacer movable with respect to the fixed marker such that the adjustable markers are moved by said gate spacer along said upper marker track.

13. The invention of claim 12 wherein the slats of said gate spacer are connected such that they are criss-crossed.

14. The invention of claim 13 wherein at least one end of a respective slat is movable connected to an end of an adjacent slat.

15. A garment marking machine comprising:

a) a marker track having at least one marker assembly positioned along said marker track, the at least one marker assembly comprising:

i) a marker cap having a bore, and ii) a marker disposed through the bore of the marker cap, the bore of the marker cap sized to tightly hold the marker;

b) a garment-supporting plate supported above the marker track; and c) at least one track spacer operative to allow said garment-supporting plate to move with respect to the at least one marker assembly between an operating position and a second position where the marker cap extends beyond said garment-supporting plate, the marker cap and the marker of the at least one marker assembly being removable when said garment-supporting plate is moved by said track spacer to the second position, the at least one track spacer comprising:

i) a top section comprising two channels therein, and ii) a bottom section comprising at least one upstanding edge sized to fit within one of the two channels of the top section, the top section operative to lower relative to the bottom section when the top section is rotated to a position where the at least one upstanding edge fits within one of the two channels.

16. The garment marking machine of claim 15 wherein said garment-supporting plate is shaped to define a slot therein, and further wherein the marker cap of the at least one marker assembly resides within the slot when said garment-supporting plate is in the operating position.

17. The garment marking machine of claim 15 wherein said at least one track spacer is disposed around at least one support post operable to support said garment-supporting plate within the garment marking machine.

18. A garment marking machine comprising:

a) a marker track having a fixed marker assembly and a plurality of adjustable marker assemblies positioned along said marker track, the marker assemblies each comprising:

i) a marker cap having a bore, and ii) a marker disposed through the bore of the marker cap, the bore of the marker cap sized to tightly hold the marker;

b) a garment-supporting plate supported above the marker track;

c) at least one track spacer operative to allow said garment-supporting plate to move with respect to the marker assemblies between an operating position and a second position where the marker caps extend beyond said garment-supporting plate, the marker caps and the markers of the marker assemblies being removable when said garment-supporting plate is moved by said track spacer to the second position, the at least one track spacer comprising:

i) a top section comprising at least one channel therein, and ii) a bottom section comprising at least one upstanding edge sized to fit within the at least one channel of the top section, the top section operative to lower relative to the bottom section when the top section is rotated to a position where the at least one upstanding edge fits within the at least one channel; and d) a gate spacer comprising a plurality of movably connected slats each having a center hole, the center hole of each slat disposed around one of the fixed or adjustable marker assemblies, said gate spacer movable with respect to the fixed marker assembly such that the adjustable marker assemblies are moved by said gate spacer along said marker track.

19. The garment marking machine of claim 18 wherein said garment-supporting plate is shaped to define a slot therein, and further wherein the marker caps of the marker assemblies reside within the slot when said garment-supporting plate is in the operating position.

20. The garment marking machine of claim 18 wherein said at least one track spacer is disposed around at least one support post operable to support said garment-supporting plate within the garment marking machine.

21. The garment marking machine of claim 18 wherein the slats of said gate spacer are connected such that they are criss-crossed.

22. The garment marking machine of claim 21 wherein at least one end of a respective slat is movably connected to an end of an adjacent slat.

* * * * *

UNITED STATES PATENT AND TRADEMARK OFFICE

CERTIFICATE OF CORRECTION

PATENT NO. : 5,323,542
DATED : June 28, 1994
INVENTOR(S) : Andrew Walzer

It is certified that error appears in the above-indentified patent and that said Letters Patent is hereby corrected as shown below:

IN THE CLAIMS

Column 11,

In claim 14, line 2, delete "movable" and substitute --movably--.

Signed and Sealed this

Eighth Day of August, 1995

*Attest:*

Bruce Lehman

BRUCE LEHMAN

*Attesting Officer*

*Commissioner of Patents and Trademarks*